US005975928A

United States Patent [19]

Tsuji

[11] Patent Number: 5,975,928

[45] Date of Patent: Nov. 2, 1999

[54] LEVER-TYPE CONNECTOR

[75] Inventor: Masanori Tsuji, Shizuoka-ken, Japan

[73] Assignee: Yazaki Corporation, Tokyo, Japan

[21] Appl. No.: 08/897,617

[22] Filed: Jul. 21, 1997

[30] Foreign Application Priority Data

Jul. 24, 1996 [JP] Japan ..... 8-194848

[51] Int. Cl.[6] ..... H01R 13/62

[52] U.S. Cl. ..... 439/157

[58] Field of Search ..... 439/157

[56] References Cited

U.S. PATENT DOCUMENTS

| | | | |
|---|---|---|---|
| 5,269,696 | 12/1993 | Okada et al. | 439/157 |
| 5,401,179 | 3/1995 | Shinchi et al. | 439/157 |
| 5,427,540 | 6/1995 | Taguchi | 439/157 |
| 5,441,420 | 8/1995 | Okumura et al. | 439/157 |

FOREIGN PATENT DOCUMENTS

| | | | |
|---|---|---|---|
| 3826332 | 8/1989 | Germany | 439/157 |
| 5-11356 | 2/1993 | Japan . | |
| 6-54253 | 7/1994 | Japan . | |

*Primary Examiner*—Steven L. Stephan
*Assistant Examiner*—Barry M. L. Standig
*Attorney, Agent, or Firm*—Oblon, Spivak, McClelland, Maier, & Neustadt, P.C.

[57] ABSTRACT

A connector structure includes a male connector housing having concave grooves, a female connector housing having convex parts for engagement with the concave groove and a manipulating lever for engaging the male connector housing with the female connector housing. The manipulating lever is provided with a pair of cam plates having pivot bearing pins and cam grooves. While, the female connector housing has a pair of cam pins formed on the convex parts for engagement with the cam grooves. When the male connector housing is engaged with the female connector housing by pivoting the manipulating lever, both sides of each concave groove are brought into contact with both sides of each convex part. Therefore, a smooth sliding movement of the male connector housing into the female connector housing can be accomplished without causing relative inclination between the male connector housing and the female connector housing.

10 Claims, 7 Drawing Sheets

LEVER-TYPE CONNECTOR

BACKGROUND OF THE INVENTION

The present invention relates to a connector structure for engaging a male connector housing and a female connector housing with each other. More particularly, it relates to a connector structure for a pair of male and female connector housings, either one of which is provided with a rotatable manipulating lever having cam grooves, while the other is provided with cam pins for engagement with the cam grooves, respectively, whereby both of the male and female connector housings can be engaged with each other by rotating the manipulating lever.

In ordinary arts, the female connector housing is provided, on each side thereof, with a manipulating lever which is rotatable about a bearing pin and which has two cam grooves formed thereon. While, the male connector housing is provided, on each side thereof, with two pins for respective engagement with the cam grooves.

In engagement, the manipulating lever is rotated on condition that one of the above cam pins is inserted into one of the cam grooves, whereby long male terminals on the side of the female connector housing are engaged with female terminals on the side of the male connector housing. Thereafter, the manipulating lever is further rotated while the other of the cam pins is inserted into the other of the cam grooves, whereby short male terminals on the side of the female connector housing are engaged with corresponding female terminals on the side of the male connector housing. In this way, the mutual engagement of the male and female connector housings can be accomplished.

In the above-mentioned connector structure, however, operative fitting force between both connector housings, which is produced owing to the respective engagement of the cam grooves with the cam pins, is not applied over the whole lengths of the connector housings uniformly. Therefore, when rotating the manipulating lever, both connector housings are inclined to each other thereby to differentiate respective contact conditions between the male terminals and the female terminals in the longitudinal direction of the connector housings. Consequently, such an inclined engagement between the male connector housing and the female connector housing causes the terminals to be deformed or damaged disadvantageously in reliability. Similarly, in case of disengaging both connector housings from each other, a problem of deformation of the terminals is also caused due to the inclination of the connector housings.

SUMMARY OF THE INVENTION

Under such a circumstance, it is therefore an object of the present invention to provide a connector structure which is capable of preventing the male and female connector housings from being slanted to each other in case of engaging the connector housings with each other or disengaging them from each other.

The object of the present invention described above can be accomplished by A connector structure comprising:

a male connector housing;

a female connector housing for engagement with the male connector housing;

a manipulating lever arranged on either one of the male connector housing and the female connector housing so as to pivot thereabout, for facilitating an operator's manipulation to engage the male connector housing with the female connector housing, the manipulating lever having at least one pivot bearing pin and at least one cam groove; and at least one cam pin arranged on the other of the male connector housing and the female connector housing, for engagement with the cam groove of the manipulating lever;

wherein either one of the male connector housing and the female connector housing has at least one concave groove or recess (hereinafter groove and recess are used interchangeably) formed so as to extendin a direction of the engagement of the male connector housing with the female connector housing, the concave groove consisting of a bottom face and a pair of opposing side faces;

wherein the other of the male connector housing and the female connector housing has at least one convex part formed so as to engage with the concave groove, the convex part having a pair of opposing side faces;

whereby, when the male connector housing is engaged with the female connector housing by an operator's manipulation of the manipulating lever, the male connector housing moves sliding on the female connector housing without any inclination of the male connector housing and the female connector housing since the side faces of the concave groove come into contact with the side faces of the convex part, respectively.

Owing to the provision of the concave groove and convex part, when the male connector housing is engaged with the female connector housing, the male connector housing moves so as to slide on the female connector housing since the side faces of the concave groove come into contact with the side faces of the convex part, respectively. Therefore, it is possible to restrict any inclination of the male and female connector housings during the engagement operation.

In the present invention mentioned above, preferably, the manipulating lever is attached on either one of the male and female connector housings so that the pivot bearing pin and the cam groove are positioned in the concave groove, while the cam pin is formed on the convex part of the other of the male and female connector housings.

With the above arrangement of the manipulating lever, it is possible to reduce a height (or thickness) of the whole connector structure.

Note, the concave groove may be formed on the male connector housing, while the convex part is formed on the female connector housing.

Preferably, the manipulating lever comprises a pair of cam plates each of which has the pivot bearing pin and the cam groove formed thereon, and a substantial U-shaped lever portion for connecting the cam plates with each other.

In this case, since the manipulating lever is arranged so as to straddle either one of the male and female connector housings, the engagement operation between the male connector housing and the female connector housing can be executed stably.

In the above mentioned arrangement, the substantial U-shaped lever portion may comprise a pair of slanted portions connected with the cam plates, a pair of arm portions each of which is disposed outside outer surfaces of the male connector housing, and a connecting portion for connecting the arm portions with each other.

It is also preferable that the connecting portion is slanted with respect to the arm portions in a rotating direction of the manipulating lever when engaging the male connector housing with the female connector housing.

In this case, with the slanting of the connecting portion, the operability in manipulating the lever can be improved.

More preferably, the connecting portion is provided with a first engagement part for fixing the manipulating lever on the male connector housing, while the male connector housing is provide with a second engagement part for engagement with the first engagement part.

In this case, owing to the provision of the first and second engagement parts, it is possible to avoid an unexpected of the male connector housing from the female connector housing.

Note, in the above-mentioned case that the manipulating lever includes the pair of cam plates, the male connector housing has a pair of the concave grooves formed thereon, while the female connector housing has a pair of the convex parts thereon, correspondingly.

In the present invention, preferably, the male connector housing has either of male terminals and female terminals, while the female connector housing has the other of the male terminals and the female terminals.

In this case, it is possible to connect the male terminals with the female terminals by pivoting the manipulating lever.

These and other objects and features of the present invention will become more fully apparent from the following description and appended claims taken in conjunction with the accompany drawing.

DESCRIPTION OF THE PREFERRED EMBODIMENT

Figure 1:
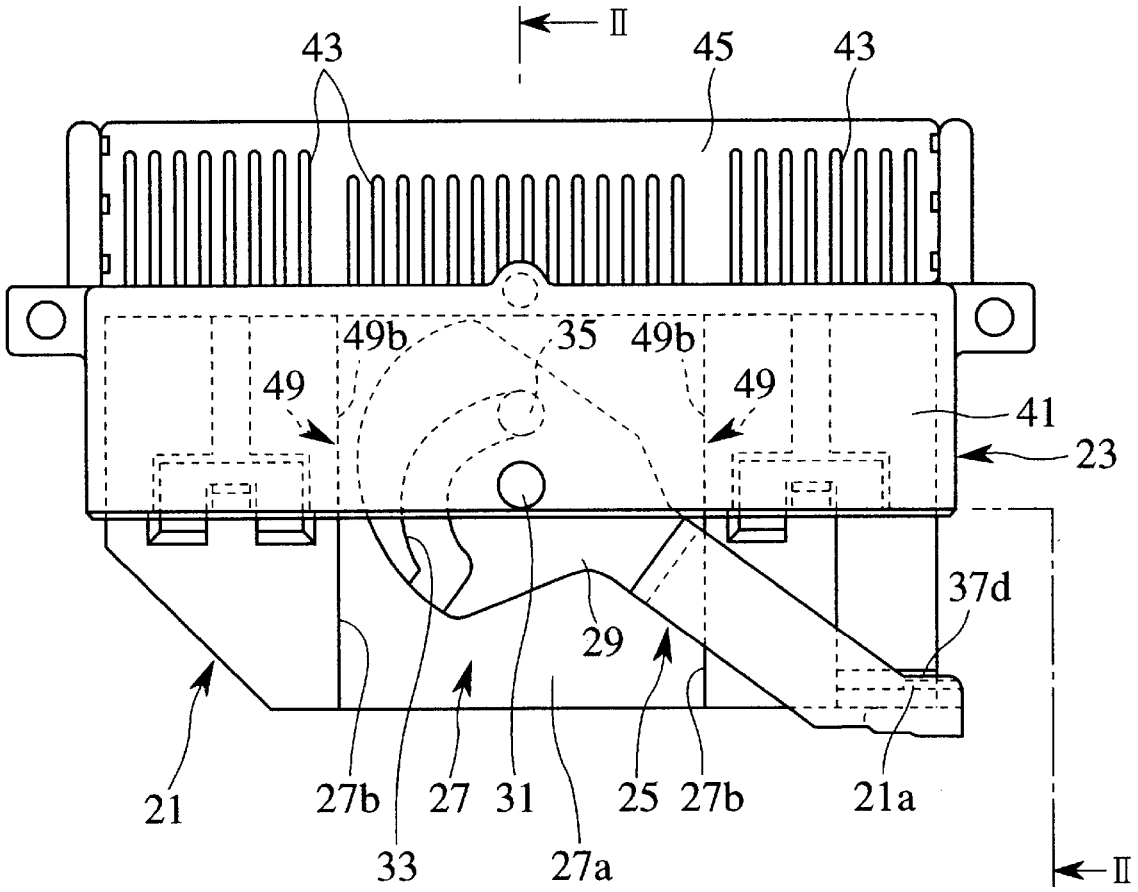
FIG. 1 is a plan view of a connector structure in accordance with an embodiment of the present invention, showing its engagement condition.
Figure 2:
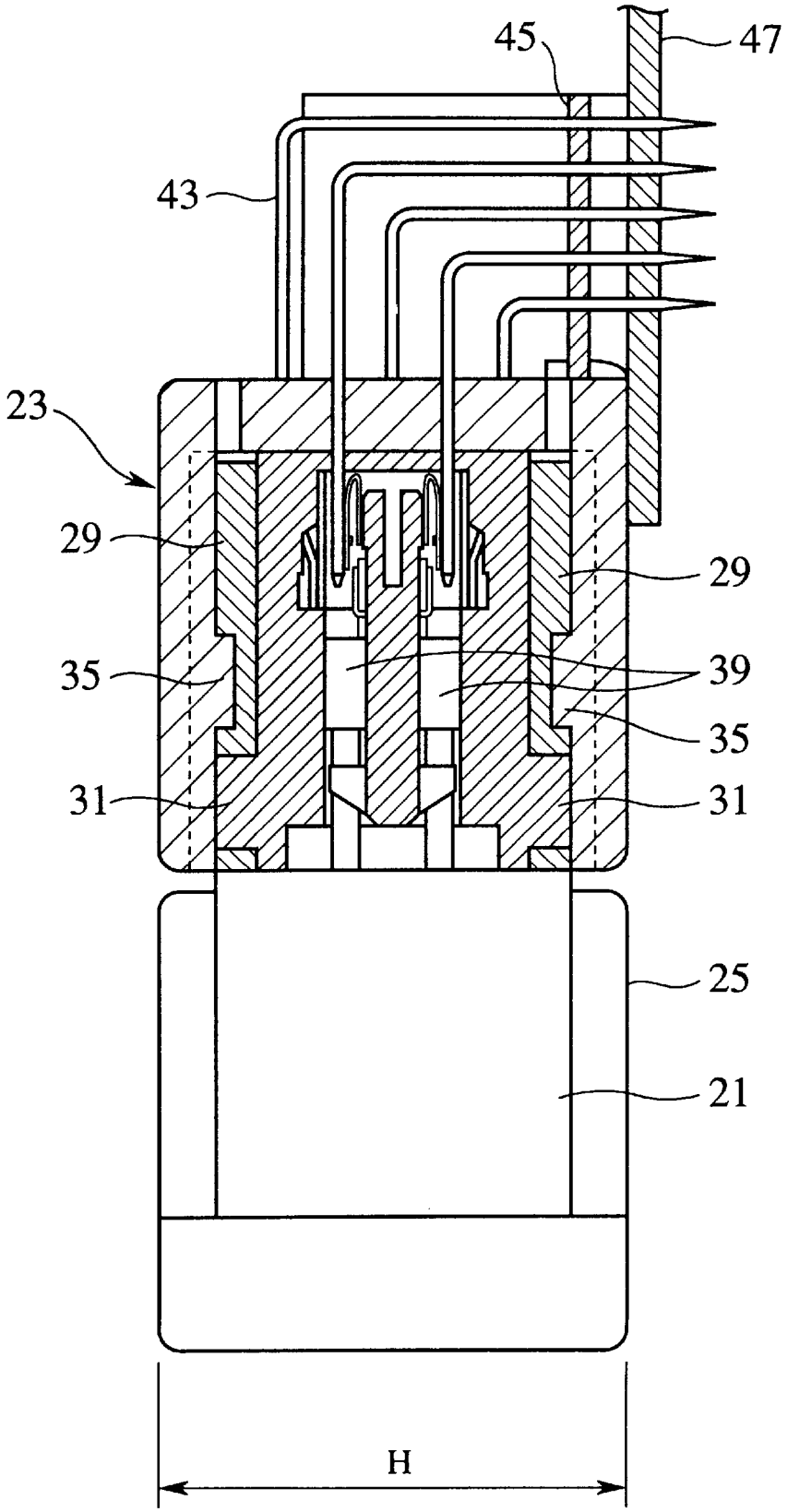
FIG. 2 is an enlarged cross sectional view of the connector structure, taken along a line II—II of FIG. 1.

Embodiments of the present invention will be described with reference to drawings. FIG. 1 is a plan view of a connector structure in accordance with an embodiment of the present invention, showing its engagement condition. FIG. 2 is an enlarged cross sectional view of the connector structure, taken along a line II—II of FIG. 1.

This connector structure includes a male connector housing 21 having female terminals therein, a female connector housing 23 having male terminals therein and a manipulating lever 25 which is manipulated so as to rotate when engaging both connector housings 21, 23 with each other or disengaging them each other.

Figure 3:
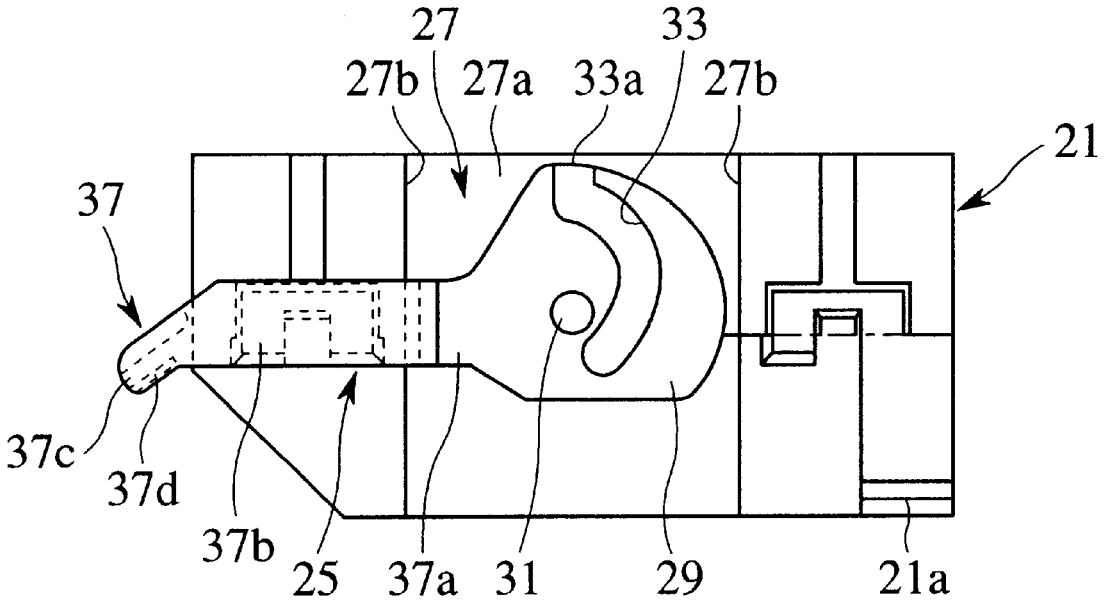
FIG. 3 is a plan view of a male connector housing of the connector structure of FIG. 1.
Figure 4:
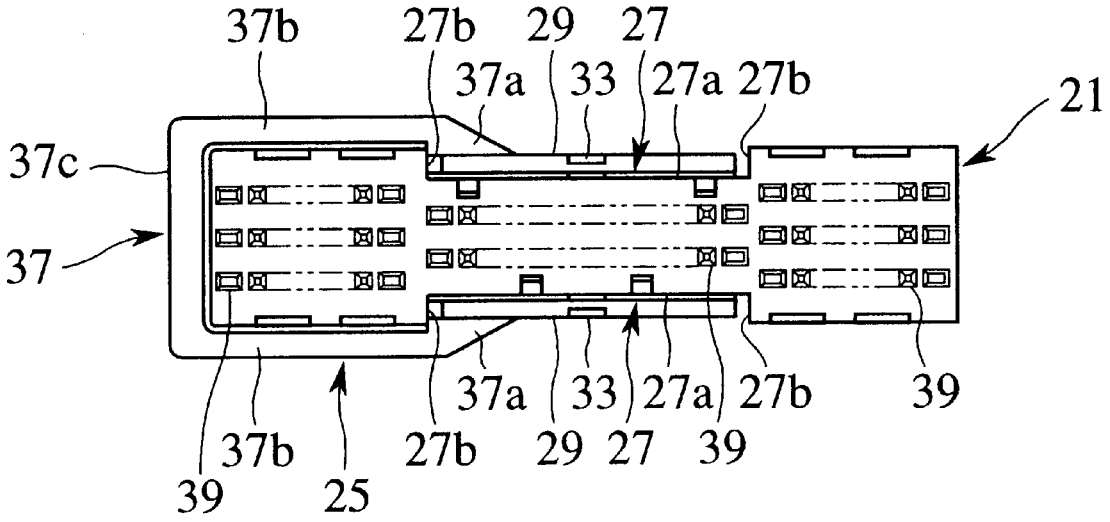
FIG. 4 is a front view of the male connector housing of FIG. 3, viewed from its fitting side.

FIG. 3 is a plan view of the male connector housing 21. FIG. 4 is a front view of the male connector housing 21, viewed from its fitting side, i.e. an upper side of FIG. 3. The male connector housing 21 is provided, on upper and lower faces thereof and at the center in the left and right directions of FIG. 4, with concave grooves 27 extending in the engagement direction of the connector housings 21, 23. Each concave groove 27 consists of a bottom face 27*a* and both side faces 27*b* constituting restricting parts. A pair of cam plates 29 of the manipulating lever 25 are accommodated in the concave grooves 27. A depth of each concave groove 27 is established to be large in comparison with a thickness of the cam plate 29. Thus, under condition that each cam plate 29 is accommodated in the concave groove 27, a top surface of the plate 29 is dented against surfaces of the male connector housing 21 on both sides of the concave groove 27, providing steps therebetween.

Rotatably inserted into the cam plate 29 is a pivot bearing pin 31 which projects at a substantial center of the concave groove 27. Further, the cam plate 29 has a cam grooves 33 formed thereon. The cam groove 33 is provided, on a fitting side thereof (i.e. the upper side of FIG. 3), with an insertion inlet 33*a* into which a cam pin 35 formed on the female connector housing 23 is inserted in the pre-engagement condition of the connector housings 21, 23, shown in FIGS. 3 and 4. The cam groove 33 is formed in an arc so as to originate at the insertion inlet 33*a* and subsequently surround the pivot bearing pin 31.

The upper and lower cam plates 29 are connected to each other through a substantial U-shaped lever portion 37 for integration. The lever portion 37 comprises a pair of slanted portions 37*a* connected with the cam plates 29, a pair of arm portions 37*b* each of which is disposed outside the surfaces of the housing 21 on both sides of the concave groove 27, a connecting portion 37*c* connecting the arm portions 37*b* with each other. As shown in FIG. 3, the connecting portion 37*c* is slanted to the arm portions 37*b* in a rotating direction of the lever 25 in engaging the connector housings 21, 23 with each other, i.e. the counter-clockwise direction of FIG. 3. Further, the connecting portion 37*c* is provided, on a lateral side thereof in the rotating direction, with an engagement part 37*d*. While, the male connector housing 21 is provided, on a side opposite thereof to the fitting side with the female connector housing 23, with an engagement part 21*a* which is to be engaged with the engagement part 37*d*, for fixing the manipulating lever 25 on the male connector housing 21.

Due to the formation of the concave grooves 27 at the center of the male connector housing 21, as obviously from FIG. 4, female terminals 39 are accommodated therein so as to form two lines in a central area corresponding to the grooves 27 while respectively forming three lines in left and right areas on both sides of the center area.

Figure 5:
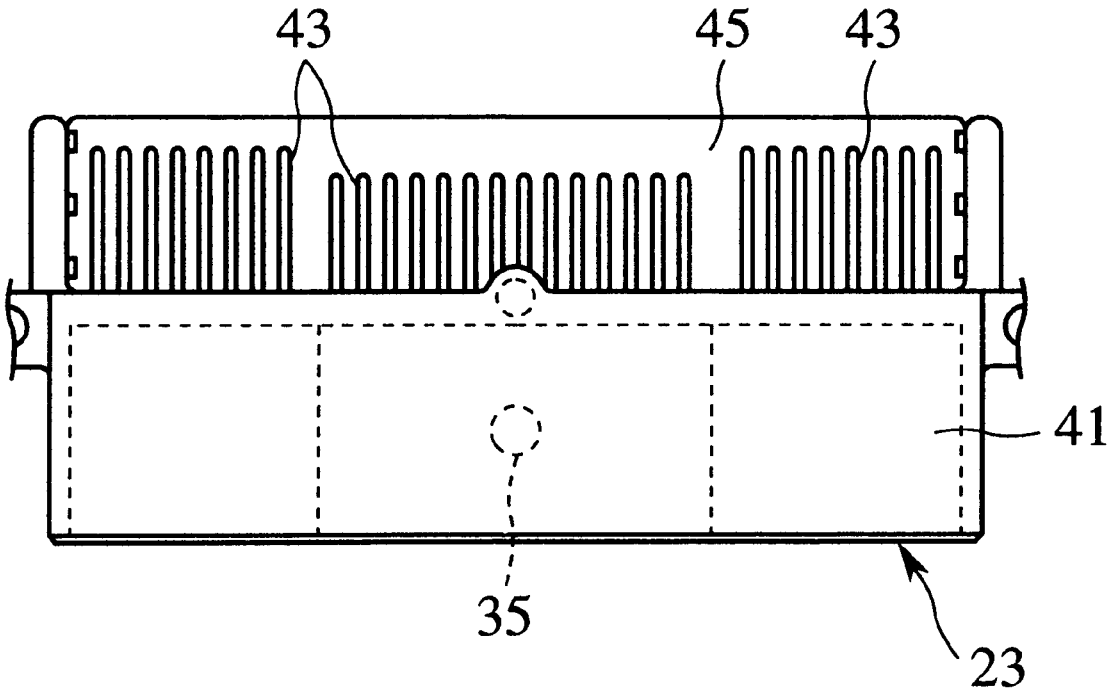
FIG. 5 is a plan view of a female connector housing of the connector structure of FIG. 1.
Figure 6:
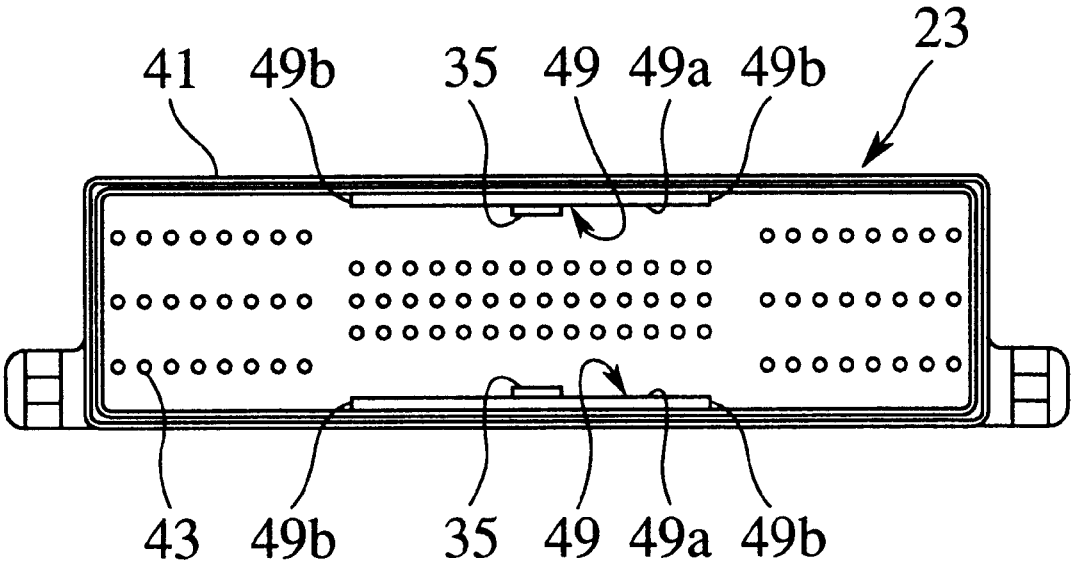
FIG. 6 is a front view of the female connector housing of FIG. 5, viewed from its fitting side against the male connector housing.

FIG. 5 is a plan view of the female connector housing 23. FIG. 6 is a front view of the housing 23, viewed from its fitting side, i.e. an lower side of FIG. 5. On the fitting side, the female connector housing 23 includes a hood portion 41 having an opening into which the male connector housing 21 is to be fitted. Projecting into the hood portion 41 are respective ends of male terminals 43 (see FIG. 2) of which respective other ends extend to the outside through the hood portion 41. Upon being bent at right angles, the other ends of the male terminals 43 are extended so as to penetrate through a plate 45 and soldered on a print substrate 47 finally.

As shown in FIG. 6, at respective positions corresponding to the concave grooves 27, the hood portion 41 includes a pair of convex parts 49 which engage into the grooves 27 and which are formed so as to cover the cam plates 29 partially. Each convex part 49 comprises an end face 49*a* opposing the bottom face 27*a* of the concave groove 27 and both side faces 49*b* constituting restricting parts for contact with the side faces 27*b* of the concave groove 27. Each convex part 49 is provided, at a center of the end face 49*a*, with a cam pin 35 which is movable in the cam groove 33 of the manipulating lever 25 on the side of the male connector housing 21.

Figure 7:
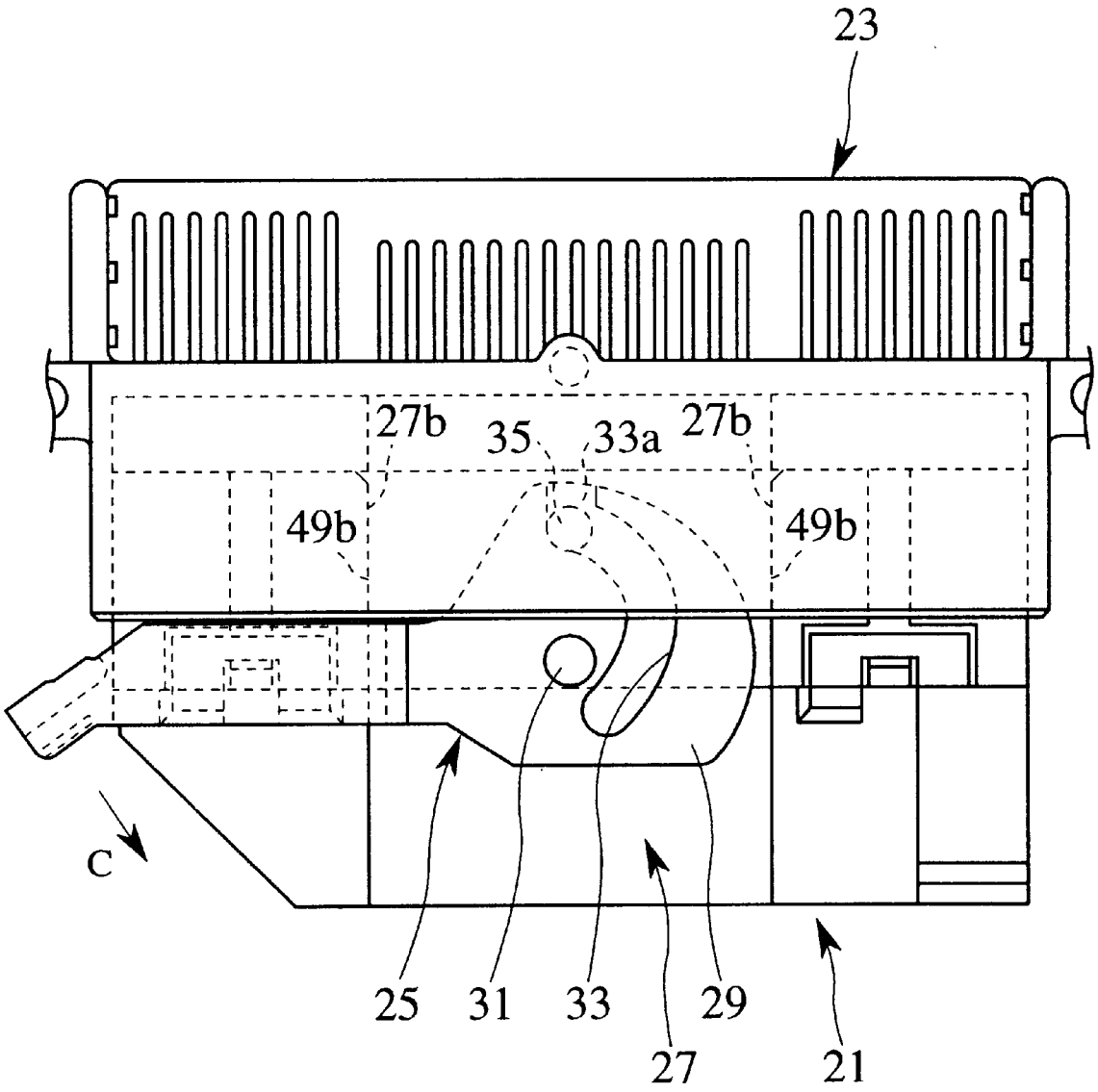
FIG. 7 is an explanatory diagram as of starting for engagement operation in the connector structure of FIG. 1.
Figure 8:
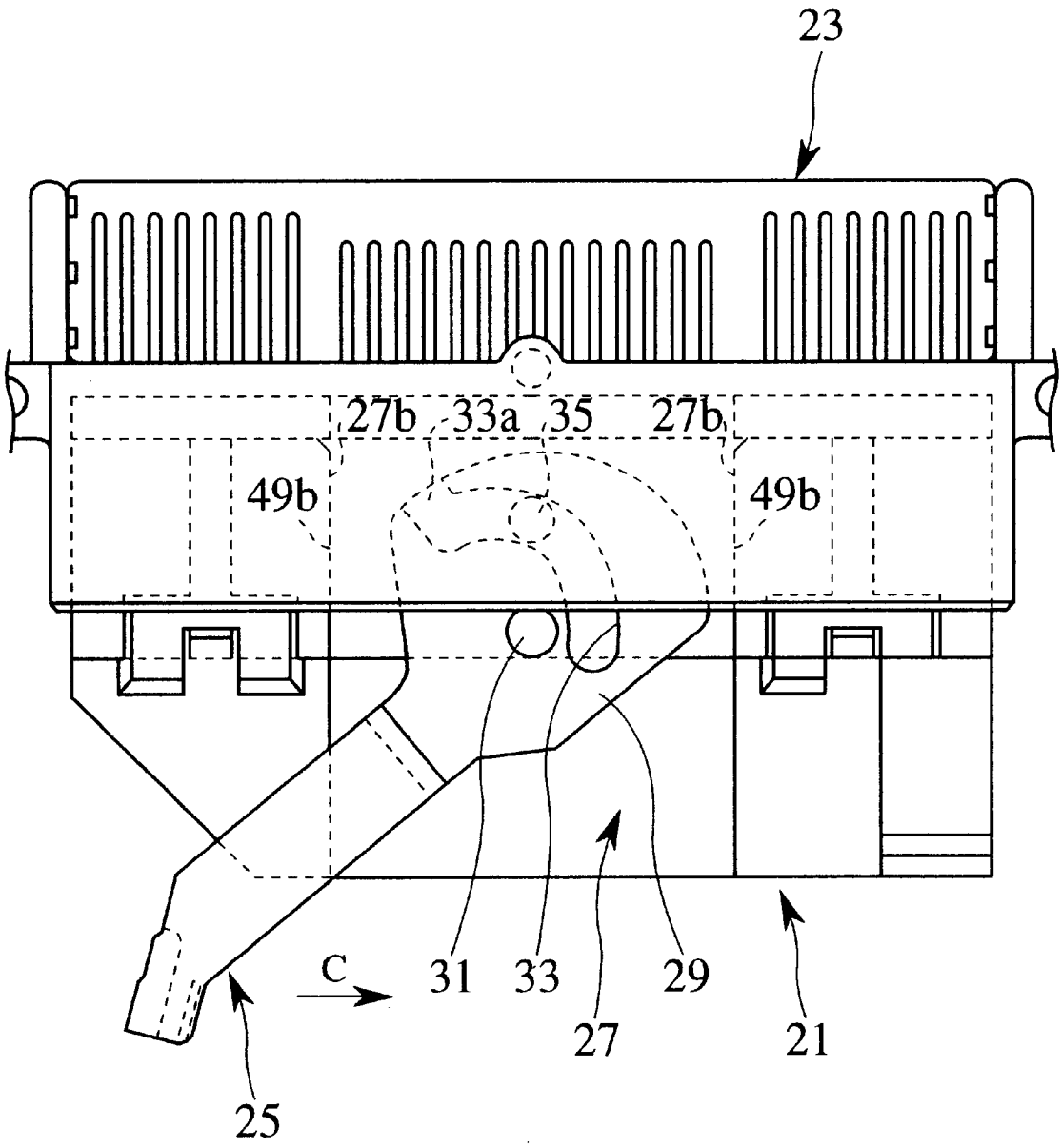
FIG. 8 is an explanatory diagram during the engagement operation in the connector structure of FIG. 1.
Figure 9:
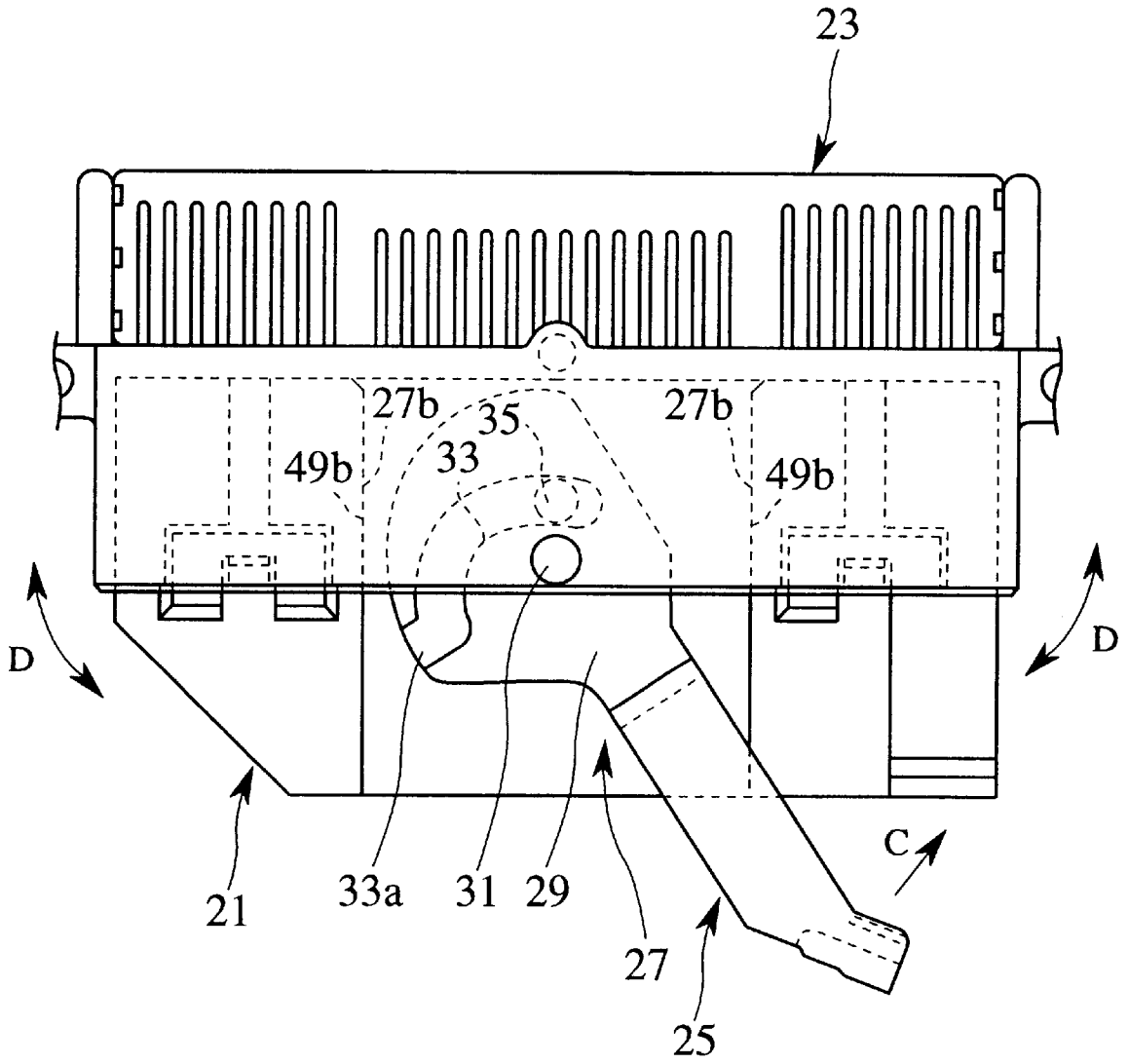
FIG. 9 is an explanatory diagram at a time of completing the engagement operation in the connector structure of FIG. 1.

We now describe an engagement operation of the so-constructed connector structure, with reference to FIGS. 7 to 9.

FIG. 7 shows the beginning of engagement operation in which the cam pins 35 on the side of the female connector housing 23 are inserted into the cam grooves 33 of the manipulating lever 25 through the insertion inlets 33*a*. Then, each convex part 49 of the female connector housing 23 enters into the concave groove 27 of the male connector housing 21 while covering the cam plate 29 of the manipulating lever 25 partially, so that both of the side faces 27*b* of the concave groove 27 come into contact with the side faces 49*b* of the convex part 49, respectively.

Under such a situation, when pivoting the manipulating lever 25 about the pivot bearing pins 31 in a direction of arrow C, the male connector housing 21 is drawn into the female connector housing 23 due to cam-action between the cam groove 33 and the cam pin 35 moving in the groove 33, so that the engagement of the male connector housing 21 with the female connector housing 23 is completed at the stage shown in FIG. 9. Note, during the operation, since the slide movement of the male connector housing 21 with respect to the female connector housing 23 is guided by mutual contact of both side faces 49*b* of the convex parts 49 with both side faces 27*b* of the concave grooves 27, so that inclinations of arrows D of FIG. 9 of the connector housings 21, 23 can be prevented by the side faces 27*b*, 49*b* serving as restricting parts. With this restriction for inclination, the contact condition of the female terminals 39 with the male terminals 43 is equalized in the width direction of the connector housings 21, 23 (corres. left and right directions of FIG. 9). Consequently, the deformation of the female terminals 39 and the male terminals 43 can be avoided thereby to improve the reliability of the connector structure.

In addition, since the manipulating lever 25 is accommodated in the concave grooves 27 formed on the male connector housing 2, the whole height of the assembled connector structure (a dimension H in FIG. 2) can be reduced, so that it is possible to avoid the connector structure from being large-sized due to the provision of the manipulating lever 25.

At a point of time when the condition shown in FIG. 1 is accomplished by the rotation of the manipulating lever 25 from the condition of FIG. 9 in the direction of arrow C, the engagement part 37*d* of the manipulating lever 25 are engaged in the engagement part 21*a* of the male connector housing 21, so that the lever 25 is fixed on the male connector housing 21. In this way, the engagement operation of the connector structure can be completed.

In order to disengage the male connector housing 21 from the female connector housing 23, the manipulating lever 25 is rotated in the opposite direction to that of the above-mentioned engagement operation. Also in this case, similar to the engagement operation, the smooth sliding movement between both connector housings 21, 23 can be effected by the guide action between the side faces 49*b* of the convex portions 49 and the side faces 27 of the convex grooves 27. As a result, the relative inclination of the connector housings 21, 23 can be restricted to prevent the female terminals 39 and the male terminals 43 from being deformed.

Although the manipulating lever 25 having the guide grooves 33 are provided on the male connector housing 21 while the guide pins 35 are provided on the female connector housing 23 in the above-mentioned embodiment, the lever 25 may be arranged on the side of the female connector housing 23 while arranging the guide pins 35 on the side of the male connector housing 21 in the modification, conversely.

Finally, it will be understood by those skilled in the art that the foregoing description is related to some preferred embodiments of the disclosed connector structure, and that various changes and modifications may be made to the present invention without departing from the spirit and scope thereof.

What is claimed is:

1. A connector structure comprising:

a male connector housing;

a female connector housing for engagement with said male connector housing;

a manipulating lever pivotally mounted on either one of said male connector housing and said female connector housing so as to pivot thereabout; and a cam mechanism composed of a first part of said manipulating lever and a second part of said male connector housing or said female connector housing on which said manipulating lever is not pivotally mounted, for facilitating an operator's manipulation to matingly engage said male connector housing with said female connector housing;

wherein either one of said male connector housing and said female connector housing has at least one recess formed so as to extend in a direction of the engagement of said male connector housing with said female connector housing, said recess consisting of a bottom face and a pair of opposing side faces extending in the direction of engagement and spaced such that the first part of said manipulating lever is received within said recess;

wherein the other of said male connector housing and said female connector housing has at least one convex part formed so as to engage with said recess, said convex part having a pair of opposing side faces extending in the direction of engagement;

whereby, when said male connector housing is engaged with said female connector housing by an operator's manipulation of said manipulating lever, said male connector housing moves slidingly into said female connector housing without any inclination of said male connector housing and said female connector housing since said pair of opposing side faces of said recess come into contact with said side faces of said convex part, respectively.

2. A connector structure as claimed in claim 1, wherein said manipulating lever has at least one pivot bearing pin and at least one cam groove, and at least one cam pin arranged on the other of said male connector housing and said female connector housing, for engagement with said cam groove of said manipulating lever, said cam groove and said cam pin constituting said cam mechanism.

3. A connector structure as claimed in claim 2, wherein said manipulating lever is attached on either one of said male and female connector housings so that said pivot bearing pin is positioned in said recess, while said cam pin is formed on said convex part of the other of said male and female connector housing.

4. A connector structure as claimed in claim 3, wherein said recess is formed on said male connector housing, while said convex part is formed on said female connector housing.

5. A connector structure as claimed in claim 4, wherein said manipulating lever comprises a pair of cam plates each of which has said pivot bearing pin and said cam groove formed thereon, and a substantial U-shaped lever portion for connecting said cam plates with each other.

6. A connector structure as claimed in claim 5, wherein said substantial U-shaped lever portion comprises a pair of slanted portions connected with said cam plates, a pair of arm portions each of which is disposed outside outer surfaces of said male connector housing, and a connecting portion for connecting said arm portions with each other.

7. A connector structure as claimed in claim 6, wherein said connecting portion is slanted with respect to said arm portions in a rotating direction of said manipulating lever when engaging said male connector housing with said female connector housing.

8. A connector structure as claimed in claim 7, wherein said connecting portion is provided with a first engagement part for fixing said manipulating lever on said male connector housing, while said male connector housing is provide with a second engagement part for engagement with said first engagement part.

9. A connector structure as claimed in claim 8, wherein said male connector housing has a pair of said recesses formed thereon, while said female connector housing has a pair of said convex parts thereon, corresponding to said pair of cam plates of said manipulating lever.

10. A connector structure as claimed in claim 1, wherein said male connector housing has either of male terminals and female terminals, while said female connector housing has the other of said male terminals and said female terminals.

* * * * *

UNITED STATES PATENT AND TRADEMARK OFFICE

CERTIFICATE OF CORRECTION

PATENT NO. : 5,975,928

DATED : November 2, 1999

INVENTOR(S) : Masanori Tsuji

It is certified that error appears in the above-indentified patent and that said Letters Patent is hereby corrected as shown below:

Col. 2, line 11, change "extendin" to --extend in--;

Col. 3., line 4, change "provide" to --provided--;

Col. 3, line 7, after "unexpected" insert --disengagement--;

Col. 3, line 25, change "accompany drawing" to --accompanying drawings--;

Col. 3, line 65, after "them" insert --from--;

Col. 4, line 18, change "grooves" to --groove--;

Col. 4, line 55, change "an" to --a--; and

Col. 8, line 6, claim 8, change "provide" to --provided--.

Signed and Sealed this

Tenth Day of April, 2001

*Attest:*

Nicholas P. Godici

NICHOLAS P. GODICI

*Attesting Officer*

*Acting Director of the United States Patent and Trademark Office*